United States Patent [19]

Eheim

[11] 4,391,257

[45] Jul. 5, 1983

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 121,867

[22] Filed: Feb. 15, 1980

[30] Foreign Application Priority Data

Mar. 10, 1979 [DE] Fed. Rep. of Germany ..... 2909556

[51] Int. Cl.[3] ..... F02D 1/18; F02D 5/00

[52] U.S. Cl. ..... 123/503; 123/506; 123/198 DB; 123/357

[58] Field of Search ..... 123/365, 377, 388, 396, 123/397, 359, 357, 449, 198 DB, 373, 503, 506, 387, 395

[56] References Cited

U.S. PATENT DOCUMENTS

| | | | |
|---|---|---|---|
| 3,025,843 | 3/1962 | Wagner | 123/198 DB |
| 3,718,123 | 2/1973 | Eckert | 123/357 |
| 4,036,193 | 7/1977 | Kobayashi | 123/357 |
| 4,278,058 | 7/1981 | Berner | 123/387 |
| 4,318,378 | 3/1982 | Eheim | 123/357 |
| 4,325,337 | 4/1982 | Eheim | 123/357 |
| 4,350,053 | 9/1982 | Folger | 123/198 D |

OTHER PUBLICATIONS

Straubel and Laufer, "Distributor Injection Pump, Type VE, Design and Examples for Application", ASME Publication, American Society of Mechanical Engineers, New York, Nov., 1978, p. 5.

*Primary Examiner*—Charles J. Myhre
*Assistant Examiner*—Carl Stuart Miller
*Attorney, Agent, or Firm*—Edwin E. Greigg

[57] ABSTRACT

The invention relates to a fuel injection pump wherein the fuel delivery to the engine is interrupted by means of a magnet. To this end, the magnet engages the governor lever at least indirectly, the governor lever is also arranged to engage the rpm governor of the fuel injection pump and further being coupled in a force-locking manner with the fuel quantity contorl member.

1 Claim, 3 Drawing Figures

FUEL INJECTION PUMP FOR INTERNAL COMBUSTION ENGINES

BACKGROUND OF THE INVENTION

The invention relates to a fuel injection pump. In known shutoff devices of this kind, either the fuel quantity control member is directly adjusted, or an adjustment is made into the governor, in both cases by means of the electric servomotor, usually an adjusting magnet. In so doing, relatively large adjustment forces must be overcome. The large adjustment forces require a large magnet, which can therefore be switched on for only relatively short periods for reasons of energy consumption. The high price, the large volume, and the energy consumption mean that there are only limited possibilities for using control means of this kind, especially in the case of small passenger car injection pumps.

OBJECT AND SUMMARY OF THE INVENTION

The fuel injection pump in accordance with the invention and having the characteristics of the main claim has the advantage over the prior art in that even a small passenger car fuel injection pump can be equipped in prefabricated fashion with a small electrical servomotor for shutoff purposes without changing the governor or any other structure. The necessary adjustment forces are reduced to a minimum, especially as a result of the embodiments disclosed.

The invention will be better understood and further objects and advantages thereof will become more apparent from the ensuing detailed description of preferred embodiments taken in conjunction with the drawings.

DESCRIPTION OF THE PREFERRED EMBODIMENTS

Figures 1, 2, 3:
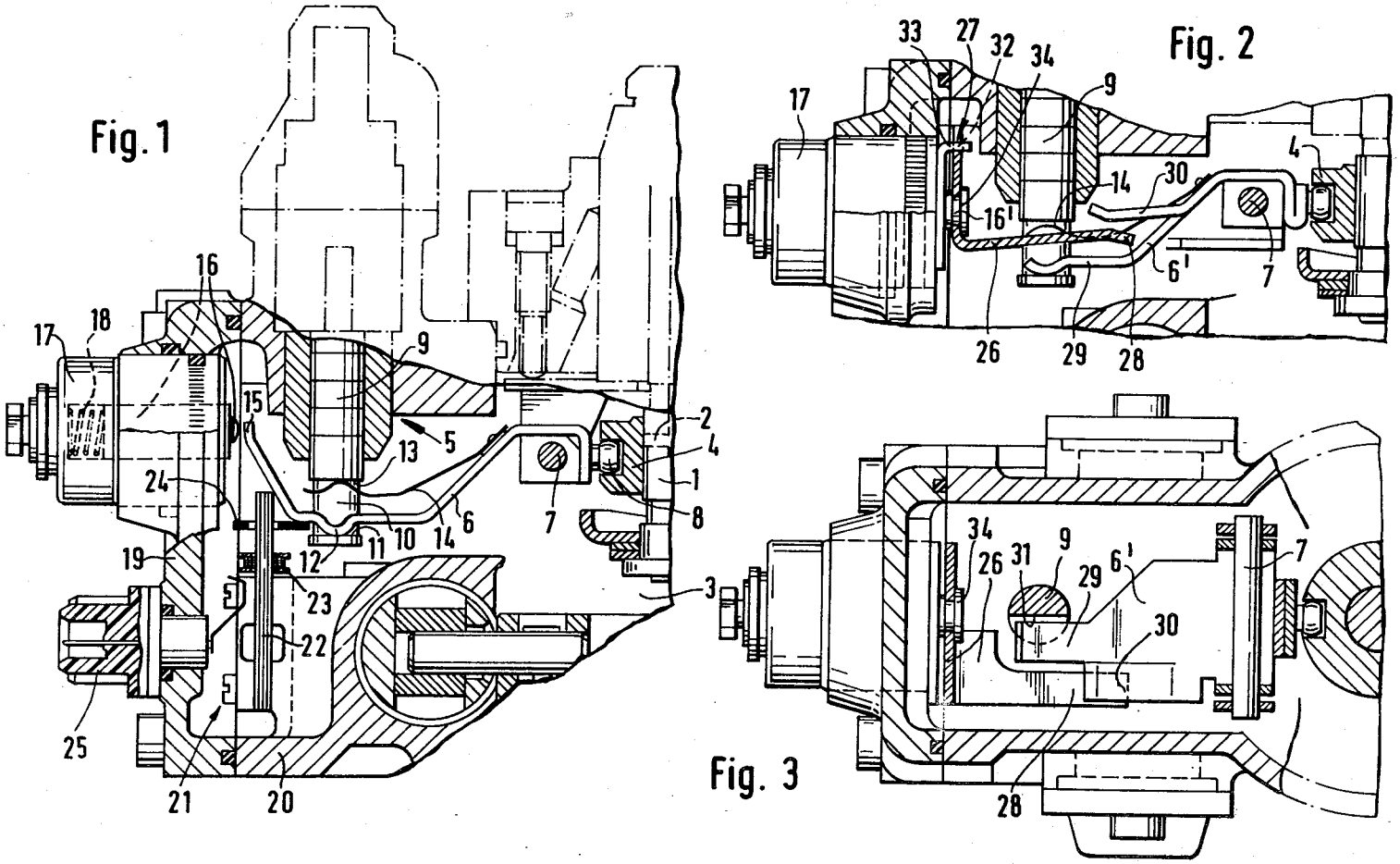
FIG. 1 shows the first exemplary embodiment in lengthwise section.
FIG. 2 shows the second exemplary embodiment in lengthwise section.
FIG. 3 shows the second exemplary embodiment in cross section.

In the lengthwise section of a fuel injection pump shown in FIG. 1, a pump piston 1 is set into simultaneously reciprocating and rotary motion by means not shown but which are well-known in the prior art. A relief channel 2 of a pump work chamber, also not shown, is disposed in this pump piston 1 and is opened toward a suction chamber 3 of the injection pump by means of an annular slide 4 which acts as the fuel quantity control member as soon as the pump piston 1 has performed an appropriate supply stroke. The quantity of fuel supplied during this supply stroke and before the opening of the relief channel 2 is then injected. The farther the annular slide 4 is displaced toward the pump work chamber, the larger is the injection quantity; the farther downward it is disposed, the smaller is the injection quantity. The pump work chamber as well is supplied with fuel from the suction chamber 3, through channels and control means which are not shown but are also well-known.

The annular slide 4 is adjusted by means of an rpm governor 5, which engages the annular slide 4 via a governor lever 6 supported at 7 and via an articulation head 8. An adjusting piston 9 of the rpm governor 5, which functions as a hydraulic governor, engages the governor lever 6. The adjusting piston 9 is actuated by the hydraulic pressure prevailing in the suction chamber 3 against the force of governor springs which are known but not shown, the force of which is preferably variable arbitrarily. The pressure in the suction chamber 3 is controlled in accordance with rpm in a known manner, and increases as the rpm increases and vice versa. If, the adjusting piston 9 is now displaced upward with increasing rpm, as a result of the increasing pressure in the suction chamber 3, then the annular slide 4 is simultaneously displaced downward, as a result of which the relief channel 2 is opened at an earlier time during the compression stroke. As a result, the injection quantity is reduced, which in turn causes a decrease in the rpm. The adjusting piston 9 has a narrowed section 10, on whose limiting end faces oriented toward the section having a larger diameter the governor lever 6 is supported. The governor lever 6 is supported directly on the annular end wall 11 by means of a deformed area 12, which carries the governor lever 6 along therewith in the direction of a decreasing fuel quantity. A drag spring 14 secured to the governor lever 6 is supported on the other limiting end wall 13. As a result, it is possible to displace the governor lever 6 into a position for zero supply (that is, complete opening of the relief channel 2), without it being necessary that the adjusting piston 9 of the rpm governor follow this motion. Thus, shutoff of the injection is possible via the governor lever 6 without the rpm governor 5 being therefore required to follow this shutoff, and in particular the adjusting lever (not shown), with which an adjustment is made in the governor for the purpose of varying the governor forces does not need to follow this shutoff.

Thus, in order to be able to displace the annular slide 4 into a position for zero delivery—that is, to displace it downward—the armature 16 of an adjusting magnet 17 engages the governor lever 6 on its terminal end portion 15 remote from the annular slide 4. In the position shown, the magnet 17 is energized, whereupon the armature 16 is drawn into the magnet against the force of a restoring spring 18. During the shutoff of the engine, the armature 16 is pushed outward by the spring 18, and the governor lever 6 is thus displaced upward against the force of the drag spring 14, so that the annular slide 4 is displaced downward into a position for zero delivery. Now, as soon as the ignition switch is actuated in order to start the engine, the magnet 17 is energized and the armature 16 is drawn inward against the force of the spring 18, as a result of which the governor lever 6, actuated by the drag spring 14, is displaced into the position shown in the figure. The annular slide 4 as a result assumes a position for full load, that is, for maximum supply quantity during normal operation. Now, as soon as the magnet 17 is switched off by means of some safety circuit or the ignition switch, the spring 18 displaces the armature 16 against the governor lever 6, so that the governor lever 6 is displaced back into a position for zero supply quantity against the force of the drag spring 14. The governor lever 6 is embodied with a bent end zone, with this bent end zone being disposed in its portion 15 and oblique to the axis of the armature 16. Thus, despite the position of the magnet 17, that is being disposed transverse to the adjusting piston 9, an adjustment is made possible. The magnet 17 is disposed in a cap 19 of the pump housing 20 perpendicular to the axis of the adjusting piston 9, so that an extremely favorable kind of structure is attained from the standpoint of temperature effects and of structural size.

As is shown in the drawing, sufficient room still remains for various other electrical transducers such as are increasingly desired in pumps of this kind. Thus, a transducer at 21 is shown here and with this, the position of the annular slide 4 can be measured for the purpose of evaluation in an electronic control device. The transducer 21 has a fixed armature 22 with a coil 23, by which a short-circuit ring 24 which is firmly connected to the governor lever 6 is displaced. Because the governor lever 6 is directly articulated on the annular slide 4, every position of the short-circuit ring 24 corresponds to one position of the annular slide 4 and thus to an actual injection quantity. The measurement result is carried further via an electrical plug 25 to the control device, which is not shown.

In the second exemplary embodiment shown in FIG. 2, a bell crank 26 is tipped by the armature 16' of the magnet 17 about a bearing point, whereupon the end 28 of the bell crank 26 remote from the bearing point 27 pulls the governor lever 6' upward and thus pushes the annular slide 4 downward to terminate injection. The governor lever 6' and the drag spring 14 function as in the previous exemplary embodiment described above. The governor lever 6', however, in this form of the invention is sheared off on the end oriented toward the adjusting piston 9, with the lower section 29 arranged to provide engagement with the adjusting piston 9 while an upper sheared section 30 acts to provide for engagement with the bell crank 26.

From FIG. 3, it can be seen how the sections 29 and 30 are disposed adjacent to one another, the section 29 being arranged to overlap the arm 28 of the bell crank 26, while section 30 is arranged to protrude into a recess 31 of the adjusting piston 9. The bell crank 26 is pushed into an opening 32 of a guide foil 33 and the armature 16' of the magnet 17 being provided with a head 34 is introduced into a corresponding opening in the bell crank 26.

The foregoing relates to preferred exemplary embodiments of the invention, it being understood that other embodiments and variants thereof are possible within the spirit and scope of the invention, the latter being defined by the appended claim.

What is claimed and desired to be secured by Letters Patent of the United States is:

1. A fuel injection pump having a housing for internal combustion engines having a control member for a fuel injection quantity actuatable by means of an adjusting member of an rpm governor via a governor lever and a drag spring which stresses said governor lever counter to a shut off direction which permits a sufficient range of motion relative to said rpm governor, and further having an electric servomotor, said servomotor including an electromagnet, an armature and a force spring which drives against said armature for adjusting the control member into a stop position in which a fuel supplied by the pump is diverted and not used, characterized in that said armature of said servomotor engages said governor lever and therethrough is connected in a force-locking manner with said control member so that upon the adjustment effected by means of said servomotor, the position of said adjusting member of the rpm governor remains unchanged, and said force spring acts upon said armature so that a fuel diversion, when the electromagnet is switched off, is triggered via said force spring and said armature.

* * * * *